US009463648B2

(12) United States Patent
Williams et al.

(10) Patent No.: US 9,463,648 B2
(45) **Date of Patent: *Oct. 11, 2016**

(54) APPARATUS AND METHOD FOR APPLYING A RELEASE AGENT TO A SUBSTRATE HAVING A PRINT IMAGE

(75) Inventors: James Edward Williams, Penfield, NY (US); Jason LeFevre, Penfield, NY (US); Jennifer Rea, Rush, NY (US); Paul McConville, Webster, NY (US); James Michael Chappell, Webster, NY (US); Jan Marie Enderle, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 297 days.

This patent is subject to a terminal disclaimer.

(21) Appl. No.: 13/517,550

(22) Filed: Jun. 13, 2012

(65) Prior Publication Data

US 2013/0337151 A1 Dec. 19, 2013

(51) Int. Cl.

| | |
|---|---|
| ***B05C 11/00*** | (2006.01) |
| ***B41J 11/00*** | (2006.01) |
| ***B41J 3/60*** | (2006.01) |
| ***G03G 15/23*** | (2006.01) |
| ***B41M 5/00*** | (2006.01) |

(52) U.S. Cl.

CPC ..... *B41J 11/0015* (2013.01); *B41J 3/60* (2013.01); *B41M 5/0011* (2013.01); *G03G 15/235* (2013.01); *G03G 2215/00801* (2013.01)

(58) Field of Classification Search

None

See application file for complete search history.

(56) References Cited

U.S. PATENT DOCUMENTS

| | | | | |
|---|---|---|---|---|
| 4,182,263 | A * | 1/1980 | Naeser et al. | 118/60 |
| 5,270,770 | A * | 12/1993 | Kukimoto et al. | 430/123.51 |
| 9,114,604 | B2 * | 8/2015 | LeFevre | B41M 5/00 |
| 2004/0101333 | A1 * | 5/2004 | Wu et al. | 399/325 |
| 2004/0120736 | A1 * | 6/2004 | Kowalski | 399/325 |
| 2005/0135847 | A1 * | 6/2005 | Bogoshian | 399/328 |
| 2006/0254445 | A1 * | 11/2006 | Masuda | B41F 19/062 101/424.1 |
| 2007/0020002 | A1 * | 1/2007 | Zess et al. | 399/325 |
| 2008/0035002 | A1 * | 2/2008 | Kuo | 101/480 |
| 2009/0324818 | A1 * | 12/2009 | Gagnon | 427/211 |
| 2010/0053239 | A1 * | 3/2010 | Furukawa | 347/6 |
| 2013/0152806 | A1 * | 6/2013 | Quan et al. | 101/2 |

* cited by examiner

*Primary Examiner* — Charles Capozzi

(74) *Attorney, Agent, or Firm* — Ronald E. Prass, Jr.; Prass LLP

(57) ABSTRACT

An approach is provided for applying a release agent to a substrate having a first surface and a second surface. The approach involves determining a presence of at least one ink image applied to at least one portion of one of the first surface and the second surface of the substrate by way of one or more steps of a printing process. The approach also involves determining the substrate is to be made ready for printing one or more other images on the other of the first surface and the second surface by one or more steps of another printing process. The approach further comprising causing, at least in part, the release agent to be applied to the substrate so as to cover the at least one portion of the first surface and the second surface of the substrate upon which the at least one ink image is applied at a time before the substrate is subjected to the one or more steps of the another printing process.

8 Claims, 6 Drawing Sheets

APPARATUS AND METHOD FOR APPLYING A RELEASE AGENT TO A SUBSTRATE HAVING A PRINT IMAGE

FIELD OF DISCLOSURE

The disclosure relates to an apparatus and method for applying a release agent useful in printing to a substrate. The release agent is applied to prevent offset of one or more inks related to an image from a substrate to one or more portions of print processing equipment during a duplex printing operation.

BACKGROUND

Duplex printing is a process in which one or more images are applied by a printing system to both a first surface and a second surface of a substrate. During some duplex printing processes, ink printed onto a substrate offsets from the substrate to various parts of printing systems such as, but not limited to, rollers, belts, baffles, winders, unwinders, stackers, etc.

Some methods for duplex printing involve first printing one or more images onto one of the first surface and the second surface of a substrate during a first printing process using a printing system, then printing one or more other images on the other of the first surface and the second surface by way of a second printing process using the same or different printing system.

For example, if the duplex printing is conducted by one or more printing systems configured for simplex printing (i.e. printing one or more images on only one of the first surface and second surface), the substrate is commonly inverted and run through the same or different print system to apply one or more other images to the other of the first surface and the second surface of the substrate.

Various conventional printing systems configured for simplex printing prevent offset of the image during the above discussed first printing process by optimizing a number of different options that include controlling: 1) ink/substrate and/or drum/roller surface temperature, 2) drum/roller surface finish, 3) absence of relative motion between ink/substrate and drum/roller surfaces, and 4) application of a release agent during the first printing process.

Conventional printing systems, however, particularly if they are set up for only simplex printing, ignore applying release agent, for example, to the other of the first surface and the second surface because that surface is typically blank (or has a pre-printed image that simply will not offset).

However, when a substrate having been subjected to the first printing process is inverted and run through a print system configured for simplex printing for the second printing process, ink applied to the substrate during the first printing process will offset to various parts of the printing system. This is because, as discussed above, a conventional simplex configured printing system does not normally have offset issues relating to a substrate that has an image applied to a backside surface of the substrate.

Though some release agent applied during the first printing process may remain on the surface having the image applied during the first printing process, this release agent is often absorbed by the substrate or migrates to various portions of the substrate between the first printing process and the second printing process. As such, there is not enough release agent present on the surface of the substrate, or at least in the desired position on the surface of the substrate, to prevent ink offset of the image applied by the first printing process during the second printing process to various portions of the print system.

SUMMARY

Therefore, there is a need to apply a release agent to a substrate to prevent ink offset from the substrate to one or more portions of print processing equipment during a duplex printing operation.

According to one embodiment, a method for applying a release agent to a substrate having at least a first surface and a second surface comprises determining a presence of at least one ink image applied to at least one portion of one of the first surface and the second surface of the substrate by way of one or more steps of a printing process. The method also comprises determining the substrate is to be made ready for printing one or more other images on the other of the first surface and the second surface by one or more steps of another printing process. The method further comprises causing, at least in part, the release agent to be applied to the substrate so as to cover the at least one portion of the first surface and the second surface of the substrate upon which the at least one ink image is applied at a time before the substrate is subjected to the one or more steps of the another printing process.

According to another embodiment, an apparatus for applying a release agent to a substrate having at least a first surface and a second surface comprises at least one processor, and at least one memory including computer program code for one or more computer programs, the at least one memory and the computer program code configured to, with the at least one processor, cause, at least in part, the apparatus to determine a presence of at least one ink image applied to at least one portion of one of the first, surface and the second surface of the substrate by way of one or more steps of a printing process. The apparatus is also caused to determine the substrate is to be made ready for printing one or more other images on the other of the first surface and the second surface by one or more steps of another printing process. The apparatus is further caused to cause, at least in part, the release agent to be applied to the substrate so as to cover the at least one portion of the first surface and the second surface of the substrate upon which the at least one ink image is applied at a time before the substrate is subjected to the one or more steps of the another printing process.

According to another embodiment, a computer-readable storage medium carrying one or more sequences of one or more instructions which, when executed by one or more processors, cause an apparatus to determine a presence of at least one ink image applied to at least one portion of one of the first surface and the second surface of the substrate by way of one or more steps of a printing process. The apparatus is also caused to determine the substrate is to be made ready for printing one or more other images on the other of the first surface and the second surface by one or more steps of another printing process. The apparatus is further caused to cause, at least in part, the release agent to be applied to the substrate so as to cover the at least one portion of the first surface and the second surface of the substrate upon which the at least one ink image is applied at a time before the substrate is subjected to the one or more steps of the another printing process.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Figure 1:
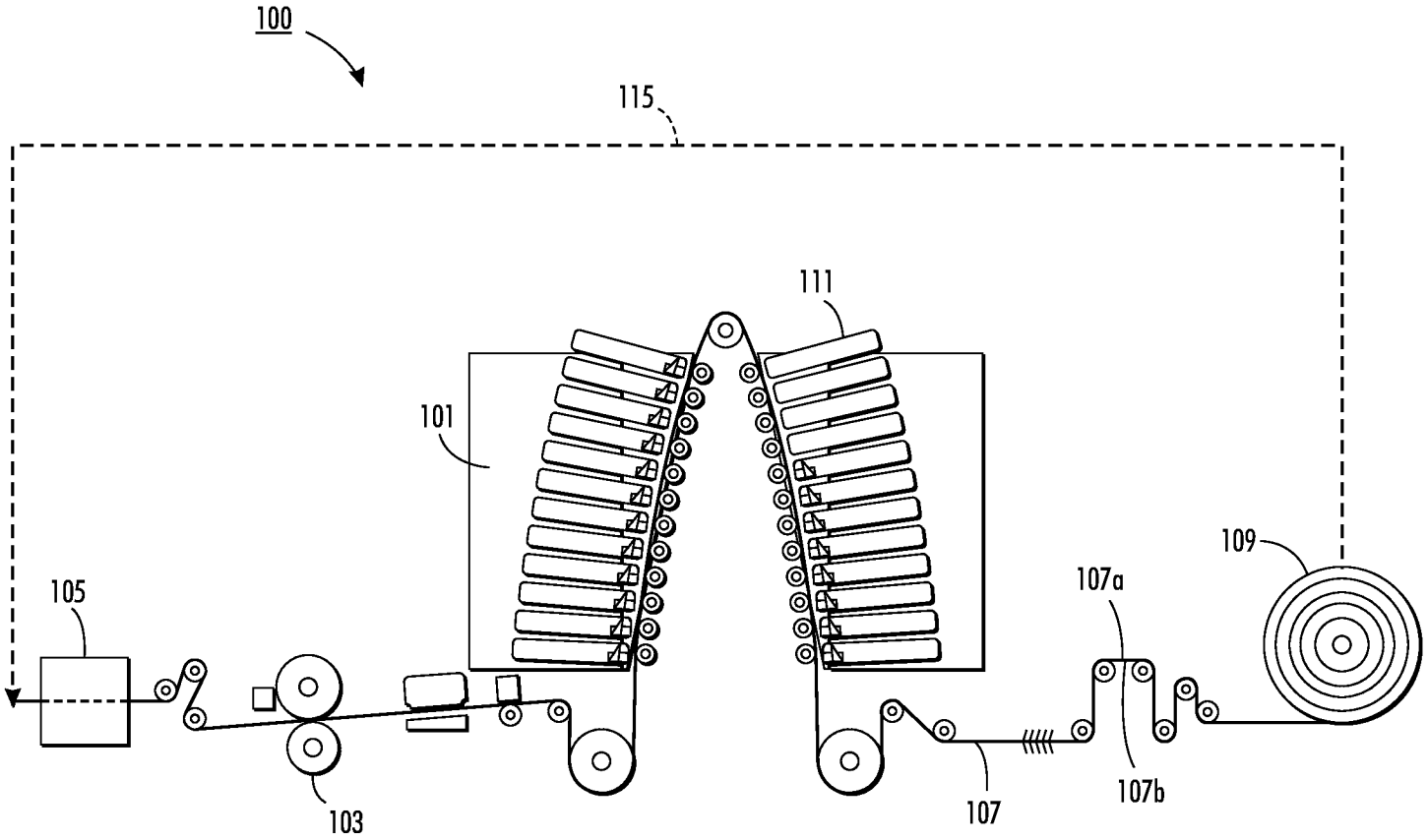
FIG. 1 is a diagram of a system capable of applying a release agent to a substrate to prevent ink offset from the substrate to one or more portions of print processing equipment during a duplex printing operation, according to one embodiment.

Examples of a method, apparatus, and computer program for applying a release agent to a substrate to prevent ink offset from the substrate to one or more portions of print processing equipment during a duplex printing operation are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures devices are shown in block diagram form in order to avoid unnecessarily obscuring the embodiments.

As used herein, the term release agent refers to any type of oil, silicone-based product, silicone mix product, water mixture, water, liquid, powder, etc. that may be applied to a printed substrate to prevent ink offset from the substrate to any printing equipment. For example, a type of oil that can be used to achieve the desired results in preventing ink offset may be Silicon based oils blended w/ small amounts of amine (e.g. 0.5% amine), or oils described as a polydimethylsiloxane+polydimethylsiloxane with aminoalkyl groups and has a kinematic viscosity in the 50 cS to 100 cS range. More specifically, the kinematic viscosity may be in a range of 70 cS to 80 cS.

Duplex printing is a process in which one or more images are applied by a printing system to both a first surface and a second surface of a substrate. During some duplex printing processes, ink printed onto a substrate offsets from the substrate to various parts of printing systems such as, but not limited to, rollers, belts, baffles, winders, unwinders, stackers, etc.

Duplex printing often involves first printing one or more images onto one of the first surface and the second surface of a substrate during a first printing process using a printing system, then printing one or more other images on the other of the first surface and the second surface by way of a second printing process using the same or different printing system.

For example, if the duplex printing is conducted by one or more printing systems configured for simplex printing (i.e. printing one or more images on only one of the first surface and second surface), the substrate is commonly inverted and run through the same or different print system to apply one or more other images to the other of the first surface and the second surface of the substrate.

Various conventional printing systems configured for simplex printing prevent offset of the image during the above discussed first printing process by optimizing a number of different options that include controlling: 1) ink/substrate and/or drum/roller surface temperature, 2) drum/roller surface finish, 3) absence of relative motion between ink/substrate and drum/roller surfaces, and 4) application of a release agent during the first printing process.

Conventional printing systems, however, particularly if they are set up for only simplex printing, ignore applying release agent, for example, to the other of the first surface and the second surface because that surface is typically blank (or has a pre-printed image that simply will not offset).

However, when a substrate having been subjected to the first printing process is inverted and run through a print system configured for simplex printing for the second printing process, ink applied to the substrate during the first printing process will offset to various parts of the printing system. This is because, as discussed above, a conventional simplex configured printing system does not normally have issues with image offset from a backside of the substrate that is typically blank.

Though some release agent applied during the first printing process may remain on the surface having the image applied during the first printing process, this release agent is often absorbed by the substrate or migrates to various portions of the substrate between the first printing process and the second printing process. As such, there is not enough release agent present on the surface of the substrate, or at least in the desired position on the surface of the substrate, to prevent ink offset of the image applied by the first printing process during the second printing process to various portions of the print system.

For example, in some duplex printing processes, a substrate, having been subjected to the above discussed first printing process is often made ready for a second printing process by rolling the substrate or stacking the substrate if the substrate is sheeted. A large portion of the printing industry (about 80% of the continuous feed industry, for example) prints product onto a substrate roll-to-roll on the printing system. That is, the substrate starts as a roll of, for example, paper, plastic, metal, carbon fiber, etc., whether initially printed or blank, the roll as it is fed into a print engine, and re-wound at the end of a print process conducted by the print engine. The roll is then often transferred at some later point in time to the same or different printing system for the second printing process.

When the substrate is wound up on a large roll, any residual release agent applied to the substrate by the print system that remains is allowed to migrate from the top surface of the substrate on either side into the center of the thickness of the substrate and/or disperse by other means such as if the roll is stood up on its side for storage the release agent may migrate to a bottom side that the roll rests upon in storage, etc. This may happen instantaneously, or after a roll is allowed to sit for some time before being subjected to the second printing process. A similar issue of migration often arises if the substrate is sheeted and stacked rather than rolled. It is this migration that is problematic for preventing offset of the image applied during the first printing process while the substrate is being subjected to the second printing process.

As discussed above, conventional printing systems set up for simplex printing, but used for duplex printing, do not have release agent application devices to coat the surface of a substrate subjected to a first printing process to prevent offset when the printed substrate is subjected to duplex printing. Additionally, some print systems are often made by different manufacturers, and/or separately located from one print system or another, and/or are separately controlled. As such, it is difficult to control the 1) ink/substrate and/or drum/roller surface temperature, 2) drum/roller surface finish, and 3) absence of relative motion between ink/substrate and drum/roller surfaces to prevent image offset in one or more conventional print systems configured for simplex printing but used for duplex printing. In fact, controlling these features may not even be helpful to prevent image offset during a duplex printing process in a simplex configured print system. Further, some print systems may not have such controllable features, or even be configured to apply a release agent to substrates during a simplex printing process for which it was initially configured.

To address this problem, a system 100 of FIG. 1 introduces the capability to apply a release agent to a substrate to prevent ink offset from the substrate to one or more portions of print processing equipment during a duplex printing operation. In addition to preventing ink offset during duplex printing, the system 100 may enable print product manufacturers to reduce their overall equipment costs. For example, print systems that are configured to accommodate duplex printing are typically more expensive than those configured for simplex printing. The system 100 enables a simplex print system to be used to conduct duplex printing with the same quality as some print systems specifically configured for duplex printing.

As shown in FIG. 1, the system 100 comprises a print system 101, a print system release agent spreader module 103 and a release agent application apparatus 105 configured to treat a substrate 107 with a release agent at least prior to entering the print system for duplex print processing.

The print system 101 may apply one or more images to a first surface 107*a* of the substrate 107 by way of any means such as offset printing or inkjet printing, for example, using print stations 111. The print system release agent spreader module 103 may apply release agent to the first surface 107*a* of substrate 107 during a first printing process 113 to aid in stripping the substrate 107 from a fuser, for example, and/or to protect various portions of the print system 101 from image offset. After the first printing process 113 is complete, the substrate is wound to create roll 109. In alternative embodiments, the substrate 107 may be provided to the print system 101 as pre-cut sheets rather than as a roll which would result in the sheeted substrate being stacked at a backend of the print system 101 rather than being wound. Or, in another embodiment, the print system 101 may be configured to receive a rolled substrate and cut the substrate 107 into sheets for stacking after completion of a printing process performed by the print system 101 to apply an image to the substrate.

As discussed above, one problem with rolling or stacking printed substrate relates to the state of the printed substrate as it enters the same or different print system 101 after some period of time that the printed roll has sat idle following the first printing process 113 on the print system 101. In the case of an immediate return to the print system 101 to subject a second surface 107*b* of the substrate 107 to a second printing process 115 to apply one or more other images to the second surface 107*b*, some residual release agent may act as a protective barrier, if enough remains on the substrate 107, to prevent ink offset of the one or more images applied to the first surface 107*a* of the substrate 107 within the print system 101.

But, an amount of the residual release agent present on the first surface 107*a* of the substrate 107 is often not reliable and ink offset still occurs. Particularly if the substrate 107 having been subjected to a first printing process 113 is allowed to sit for some period of time before the second printing process 115 to apply one or more images to the second surface 107*b*.

Accordingly, the release agent application apparatus 105 is positioned before the substrate is subjected to a seconding printing process in which the roll 109 or stacked substrate is re-run through the same print system 101 or a different print system 101 after the substrate 107 is subjected to the first printing process 113.

Accordingly, the release agent application apparatus 105 controls the state of the substrate going into the print system 101 for a second printing process 115 by applying a release agent to the first surface 107*a* of the substrate 107, for example, when the second printing process 115 applies one or more images to the second surface of the substrate 107*b*. The application of release agent to the first surface 107*a* of the substrate 107 before the substrate 107 is subjected to the second printing process 115 protects various portions of the print system 101 that the first surface 107*a* may contact during the second printing process 115 from ink offset.

According to various embodiments, the release agent application apparatus 105 may be positioned to protect nearly any configuration of print system 101's by retrofitting the release agent application apparatus 105 to fit the print system 101, retrofitting the print system 101 to accommodate the release agent application apparatus 105, or by using a free-standing release agent application apparatus 105 to condition a substrate 107 with release agent and protect the print system 101 from ink offset. For example, whether free-standing, or retrofitted, the release agent application apparatus 105 may be attached to, or placed in front of, the in-feed side of the print system 101 and configured to apply a layer of release agent to the first surface 107*a*, in this example. It should be noted that the print system 101 may be configured to apply one or more images to the second surface 107*b*, and the substrate 107 re-run through the same print system 101 or a different print system 101 to apply one or more other images to the first surface 107*a* in the second printing process 115. In other words, the release agent application apparatus 105 is configured to apply release agent to whichever surface of the substrate 107 is to be subjected to the second printing process 115.

Evidence suggests that the ink offset performance varies greatly depending on whether the substrate 107 has or has not been freshly treated with release agent. A freshly treated image that is immediately fed into a print system 101 for a second printing process 115 is far more robust to ink offset than an image that has been treated at a prior time, allowed to sit (for some time greater than one hour, or even a few minutes, for example), and then fed back into the print system 101 for the second printing process 115.

Accordingly, when residual release agent applied by the print system release agent spreader module 103 carryout is low (i.e., the residual amount of release agent being less than 2 mg/A4 paper size), and the substrate is allowed to sit for a period of time, greater than a day, for example, it is typical for inked areas of the substrate 107 to cause a severe amount of ink offset to, for example, a stationary baffle, rollers or belts in the print system 101 during the second printing process 115.

But, when the residual release agent applied by the print system release agent spreader module 103 oil carryout is high (i.e., the residual amount of release agent being about 7-8 mg/A4 paper size) there is typically no evidence of ink offset onto the various portions of the print system 101 over long runs of duplex printing.

While a print system may be configured to apply a release agent for its own print processing, any residual release agent is an unreliable source of ink offset protection. Additionally, though it may be feasible to cause high oil carryout by increasing the output of release agent applied to the substrate 107 by the print system release agent spreader module 103 to result in higher residual release agent carryout, this would require over applying the release agent to the first surface 107*a* of the substrate 107, for example, by the release agent spreader module 103 in hopes of causing an overabundance of release agent to remain on the first surface 107*a* of the substrate 107 through the first printing process 113 performed by the print system 101, and then remain on the first surface 107*a* of the substrate 107 after the first printing process 113 is complete, and the substrate 107 is allowed to sit for a period of time before being subjected to the second printing process 115.

However, such practice is impractical for many reasons. For example, flooding the first surface 107*a* of the substrate 107 with release agent by the print system release agent spreader module 103 is expensive because it wastes release agent by applying an overabundance of release agent. Additionally, applying too much release agent during or before the first printing process 113 may affect image quality because the release agent may saturate the substrate 107, or migrate unevenly across the substrate 107 during the first printing process 113 which would affect ink/image adhesion and/or absorption.

Therefore, to avoid waste, make applying a release agent a greener step in a print product manufacturing process, and to avoid image quality issues, the release agent application apparatus 105 is configured to apply release agent to the substrate 107 at an opportune time in the print product manufacturing process. That is, before the printed substrate 107 enters the print system 101 for the second printing process 115.

Additionally, to avoid one or more of waste and oversaturation, the release agent application apparatus 105 is configured to selectively apply one or more controlled amounts of release agent to the substrate 107. For example, in one embodiment, the release agent application apparatus 105 is configured to selectively apply the release agent at an a rate that may be fixed or adjustable depending on the configuration of the release agent application apparatus of 2 mg/A4 paper size to 12 mg/A4 paper size. In another embodiment, the release agent application apparatus 105 is configured to selectively apply the release agent at an a rate that may be fixed or adjustable depending on the configuration of the release agent application apparatus of 4 mg/A4 paper size to 10 mg/A4 paper size. In another embodiment, the release agent application apparatus 105 is configured to selectively apply the release agent at an a rate that may be fixed or adjustable depending on the configuration of the release agent application apparatus of 7 mg/A4 paper size to 8 mg/A4 paper size.

By applying a selected controlled amount of release agent, the release agent application apparatus 105 applies an optimal amount of release agent to the substrate 107 to prevent ink offset to various portions of the print system 101 during the second printing process 115 without flooding the substrate 107 with release agent and relying on a residual amount to remain. Additionally, by applying the release agent at the opportune time, such as just as the substrate is about to enter the print system 101 for the second printing process 115, any migration effects caused when the release agent moves around the substrate 107 over time are mitigated.

According to various embodiments, the release agent application apparatus 105 may be configured to determine a position of an image on the substrate 107 by way of various sensors or user control to selectively apply the release agent only to portions of the substrate 107 upon which the image is detected. For example, the release agent application apparatus 105 may be configured to determine whether an image is present on any side of a substrate 107 by way of a sensor, for example.

For example, the release agent application apparatus 105 may determine that an image is present on the first surface 107*a* and not on the second surface 107*b* (or the second surface 107*b* and not the first surface 107*a*), and therefore be caused to only apply release agent to the surface of the substrate 107 having the determined image. Such a determinable application of release agent may enable, for instance, the release agent application apparatus 105 to provide release agent to the proper side of the substrate 107 for duplex printing offset protection, regardless of how the print system 101 is configured to apply an image to the substrate 107. For example, it would not matter whether the print system 101 were configured to print face up or face down in its simplex print mode. Rather, the release agent application apparatus 105 may be configured to automatically adjust which surface of the substrate 107 is to receive the release agent to prevent image offset. Or, since the release agent application apparatus 105 may be configured to apply release agent to both surfaces 107*a* and 107*b* of the substrate 107, the release agent application apparatus 105 could be instructed to coat both sides of the substrate 107 on demand, for example, if the release agent spreader module 103 were to break down, or if for some reason it is desirable to coat both surfaces of the substrate 107 with release agent.

In one or more embodiments, the release agent application apparatus 105 may be caused to apply a release agent to only the portion, or portions, of the side 107*a*/107*b* of the substrate 107 having the detected image, or the release agent application apparatus 105 may be selectively caused to apply release agent to an entire side of the substrate 107 having the detected image, for example. The portions of the substrate 107 upon which the release agent is applied on account of the determined image may be limited to tracing of the image itself, portions slightly smaller than the image to avoid overuse of release agent, or portions slightly larger than the image but smaller in area that an entire surface of the substrate 107 upon which the image is applied. For example, the portion may be a geometrical shape such as a square within which the image lies or a sector of the surface of the substrate 107 upon which the image is applied, or the portion may be a traced shape of the image fully coating the image and having a boarder around the image formed from release agent.

According to various embodiments, as discussed above and illustrated in more detail below in FIG. 3, the release agent application apparatus 105 may, for example, include a release agent supply device, a roller such as a hard donor roll which may also be configured as a belt, and a metering device that supplies a metered amount of release agent to the roller.

According to various embodiments, as discussed above and illustrated in more detail below in FIG. 3, the release agent application apparatus 105 may take many forms. For example, in one embodiment, the release agent application apparatus 105 may be of a nipped roller pair type comprising a hard-roll and a conformable roller. Release agent may be metered to a hard-roller surface and then transferred to the substrate 107 upon passing through the nip formed by the hard-roll and the conformable roller. Metering the release agent to the hard-roll surface can be done by any number of different ways, such as any digital metering unit, RAM-style oiling system, etc. According to various embodiments, the hard-roll may be any of an aluminum drum coated w/ an anodize (e.g. "Hardcoat" or "Hardlube") intended to deliver desired surface roughness and durability, ceramic, other metal, plastic, carbon fiber, etc. The conformable roller may be constructed of any type of steel core coated w/ polyurethane rubber or any other coating of any material of a given thickness (e.g. 2.5 mm) to enable conformability, or any solid polymer, composite, other metal that is softer than a metal of the hard roll, carbon fiber, or any material or combination of materials such that the conformable roller is configured to deform more than the hard roll under a same pressure.

Alternatively, the rollers that form the nipped roller pair may both be hard-rolls or conformable rollers. As discussed above, the release agent may be metered to the hard-roll surface, but it should be noted that in one or more embodiments, the release agent may be metered to either of the hard-roll surface, the conformable roller, both the hard-roll and the conformable roller to apply release agent to multiple sides of the substrate 107, or both the hard-roll or both the conformable roll if the release agent application apparatus 105 is so configured.

According to various embodiments, the thermal state of the nipped roller pair need not be any hotter than the ambient surroundings. Accordingly, there is no need for either roll to be thermally controlled. The pressure within the nip would only need to be sufficient enough to enable conformance between the hard-roll and the media/ink. But, in other embodiments, any of the rolls in the release agent application apparatus may be heated to enhance a flow rate or spreading of the release agent or cleaning the rollers, and/or the metering unit may be configured to heat the release agent to aid in enhancing the flow rate of or spreading of the release agent, or cleaning, for example.

According to various embodiments, the release agent application apparatus 105, if configured to be a nipped roller pair type, is configured to apply a pressure to the substrate 107 as the substrate 107 passes through the nipped roller pair that is sufficient for spreading the release agent evenly upon application to the selected portions, or over the entire selected surface of the substrate 107. For example, in one embodiment, the pressure may be fixed or variable. The pressure applied by the nipped roller pair type release agent application apparatus 105 is in a range of 0.1 psi to 1500 psi. In another embodiment, the pressure applied by the nipped roller pair type release agent application apparatus 105 is in a range of 100 psi to 1000 psi. In another embodiment, the pressure applied by the nipped roller pair type release agent application apparatus 105 is in a range of 200 psi to 500 psi. The pressure applied may be controlled to be any of the amount within the ranges discussed above, or simply controlled to apply a pressure within a selected or predetermined range, and may be limited to one or more selected portions or an entire surface side of the substrate.

According to various embodiments, alternatively, or in addition to the release agent application apparatus 105 being a nipped roller pair type release agent application apparatus, the release agent application apparatus 105 may be fitted with one or more spray nozzles that may be actuated to selectively apply a release agent to the substrate 107. The amount of release agent may be metered to be any of the amounts discussed above, and may be limited to one or more selected portions or an entire surface side of the substrate, as discussed above.

According to various embodiments, alternatively, or in addition to the release agent application apparatus 105 being a nipped roller pair type release agent application apparatus, and/or the release agent application apparatus 105 being fitted with one or more spray nozzles, the release agent application apparatus 105 may be fitted with one or more belts that are configured to selectively apply a release agent to the substrate 107. The amount of release agent may be metered to be any of the amounts discussed above, and may be limited to one or more selected portions or an entire surface side of the substrate, as discussed above.

According to various embodiments, the release agent application apparatus 105 may be controlled by any means such as by way of integrated switches and/or user interface. Alternatively, or in addition to such controls, any number of release agent application apparatuses 105 may be configured to be controlled by way of a central control unit that is remote from any of the release agent application apparatuses 105 and communicates with one or more of the release agent application apparatuses 105 by any means such as a wired or wireless network, for example. Such control and communication, whether onboard or remote from any number of release agent application apparatuses 105, may be facilitated and/or caused by way of a chipset such as that discussed below in FIG. 6.

Figure 2:
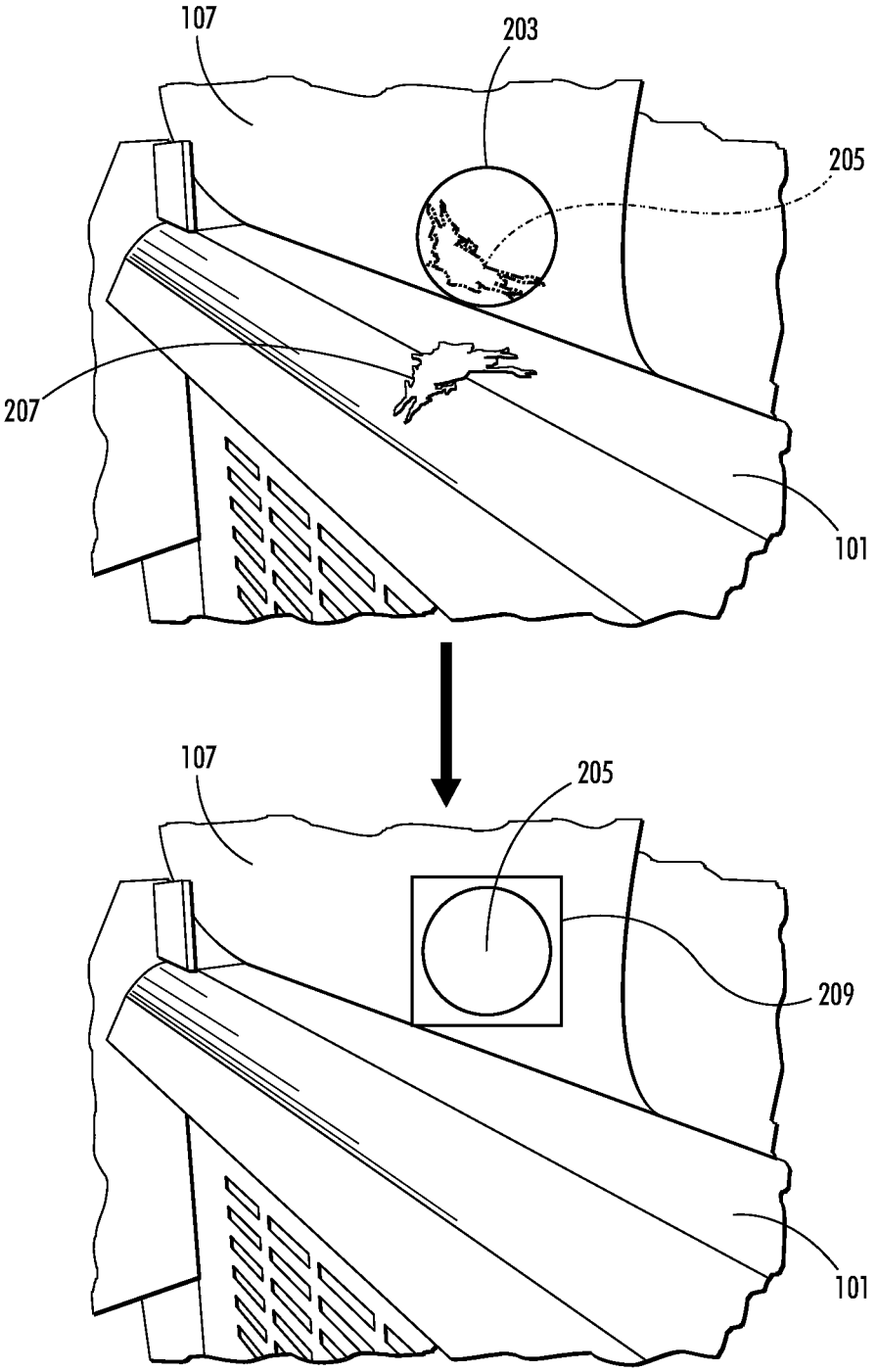
FIG. 2 is a diagram illustrating ink offset, according to one embodiment.

FIG. 2 illustrates a comparison of a portion of a print system 101 having a substrate 107 with an image 203 applied by the first printing process 113 run through the print system 101 for the second printing process 115. One image shows the substrate 107 having been coated with a sufficient amount of release agent and one not so coated. The substrate 107 has an image 203 printed on one side of the substrate 107.

In one example, where the substrate 107 does not have a sufficient amount of release agent applied to it, a portion of the image 205 may be offset as ink offset 207 to the print system 101 so that the image 203 looks either incomplete, or has an unwanted finish, for example. Additionally, ink offset 207 may be transferred to other substrate 107 portions that pass through the print system 101. If the ink offset 207 is transferred, it may ruin an image 203 that is printed on a subsequent portion of substrate 107, or subsequent substrate 107 (if sheeted, for example) by causing streaking, ruining a printed finish of the image 203 and/or just covering the image 203 with unwanted ink, for example. Further, ink offset 207 may also be transferred to other portions of the print system 101 by subsequent substrate 107 portions as it is dragged through the print system 101 during the second printing process 115.

But, when release agent 209 is applied by the release agent application apparatus 105 discussed above to cover at least the determined portion of the substrate 107 having the image 203 at the amounts discussed above such as but not limited to 7-8 mg/A4 size paper, there is no evidence over long runs of printed product of ink offset 207 to various portions of the print system 101.

Figure 3:
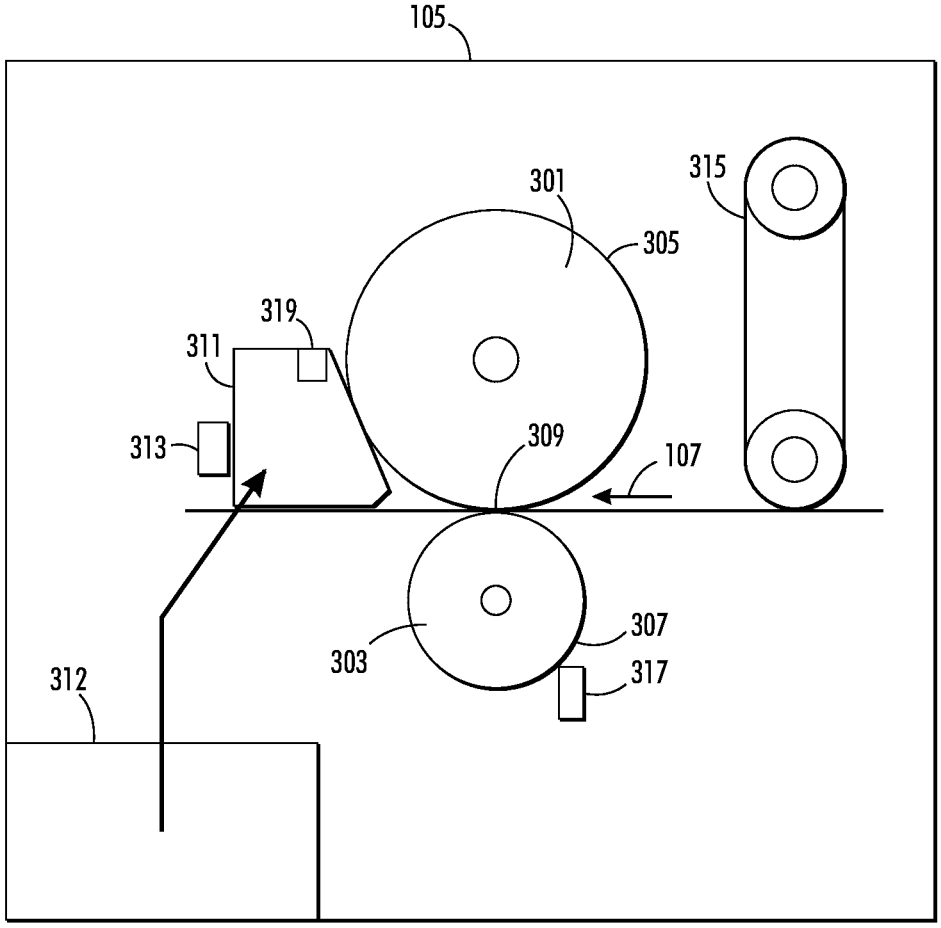
FIG. 3 is a diagram of a release agent application apparatus, according to one embodiment.

FIG. 3 is a diagram of the release agent application apparatus 105. As shown, the release agent application apparatus 105 has a nipped roller pair comprising a hard-roll 301 and a conformable roller 303. Release agent may be metered to a hard-roller surface 305 and then transferred to the substrate 107 upon passing through the nip 309 formed by the hard-roll 301 and the conformable roller 303. Metering the release agent to the hard-roll surface can be done by any number of different ways, such as any metering unit 311 that may be a digital metering unit, RAM-style oiling system, etc.

As discussed above, the hard-roll 301 may be any of an aluminum drum coated w/ an anodize (e.g. "Hardcoat" or "Hardlube") intended to deliver desired surface roughness and durability, ceramic, other metal, plastic, carbon fiber, etc. The conformable roller 303 may be constructed of any type of steel core coated w/polyurethane rubber or any other coating of any material of a given thickness (e.g. 2.5 mm) to enable conformability, or any solid polymer, composite, other metal that is softer than a metal of the hard roll, carbon fiber, or any material or combination of materials such that the conformable roller 303 is configured to deform more than the hard roll 301 under a same pressure.

Alternatively, the rollers 301/303 that form the nipped roller pair may both be hard-rolls or conformable rollers. As discussed above, the release agent may be metered to the hard-roll surface 305, but it should be noted that in one or more embodiments, the release agent may be metered to either of the hard-roll surface 305, the conformable roller 303, for example on a conformable roller surface 307, or from an inside of the conformable roller 303 so as to, permeate outward for application to the substrate 107, both the hard-roll 301 and the conformable roller 303 to apply release agent to multiple sides of the substrate 107. Alternatively, both the hard-rolls 301 or both the conformable rollers 305 may have release agent metered to them if the release agent application apparatus 105 is so configured. It should be noted that while this example shows only two rollers 301/303 that form the nipped roller pair, the release agent application apparatus 105 may be configured to have any number of rollers of any type or combination of types to form or not form any number of nipped roller pairs. Additionally, the release agent application apparatus 105 may be configured to apply release agent to the substrate 107 in any direction the substrate moves through the release agent application apparatus 105, and the metering unit 311 may be configured to meter release agent to one or both of the rollers 301,303. Alternatively, the release agent application apparatus 105 may be configured to have independent metering units 311 to meter release agent to any respective roller.

If the release agent application apparatus 105 is configured to have multiple independent metering units 311, the release agent application apparatus may, in various embodiments, further be configured to use any of the multiple metering units 311 as backup systems to control the application of release agent to any other roller than its respective roller, for example, in the case of a malfunction. Or, if the metering units 311 are independently sourced by one or more source reservoirs 312, or are sources themselves, for example, the metering units 311 may provide release agent by way of a connector channel, for example, to other metering units 311. The flow of release agent from one metering unit 311 to another metering unit 311 may be controlled to allow release agent to flow from one metering unit 311 to another metering unit 311 by the source metering unit 311, the receiving metering unit 311, or an overall system control unit having a chipset discussed below in FIG. 6 to provide for redundancies and allow for seamless protection of the print system 101 from ink offset in a case of a partial breakdown.

As discussed above, according to various embodiments, alternatively, or in addition to the release agent application apparatus 105 being a nipped roller pair type, the release agent application apparatus 105 may be fitted with one or more spray nozzles 313 that may be actuated to selectively apply a release agent to the substrate 107. The amount of release agent may be metered to be any of the amounts discussed above, and may be limited to one or more selected portions or an entire surface side of the substrate 107, as discussed above.

According to various embodiments, alternatively, or in addition to the release agent application apparatus 105 being a nipped roller pair type, and/or the release agent application apparatus 105 being fitted with one or more spray nozzles 313, the release agent application apparatus 105 may be fitted with one or more belts 315 that are configured to selectively apply a release agent to the substrate 107. The amount of release agent may be metered to be any of the amounts discussed above, and may be limited to one or more selected portions or an entire surface side of the substrate, as discussed above.

According to various embodiments, the release agent application apparatus 105 may be configured to drive the substrate 107 through it by way of one or more motors 317 that may drive one or more of the hard-roll 301, conformable roller 303, belt 315, etc. for example. Alternatively, or in addition to being driven, the substrate 107 may be drawn through the release agent application apparatus 105 by way of web tension that may be caused by the print system 101 downstream of the release agent application apparatus 105 in a process direction, for example.

As discussed above, the release agent may be heated to aid in spreading the release agent and/or cleaning the release agent application apparatus 105. For example, the release agent application apparatus 105 may be outfitted with one or more heat elements 319 that may be integrated into any of the rollers 301, 303, the metering unit 311, or configured to heat the belt 315. Alternatively, or in addition to the heat element 319 being integrated into the any portion of the release agent application apparatus 105, the heat element 319 may preheat any release agent stored in one or more source reservoirs 312.

Figure 4:
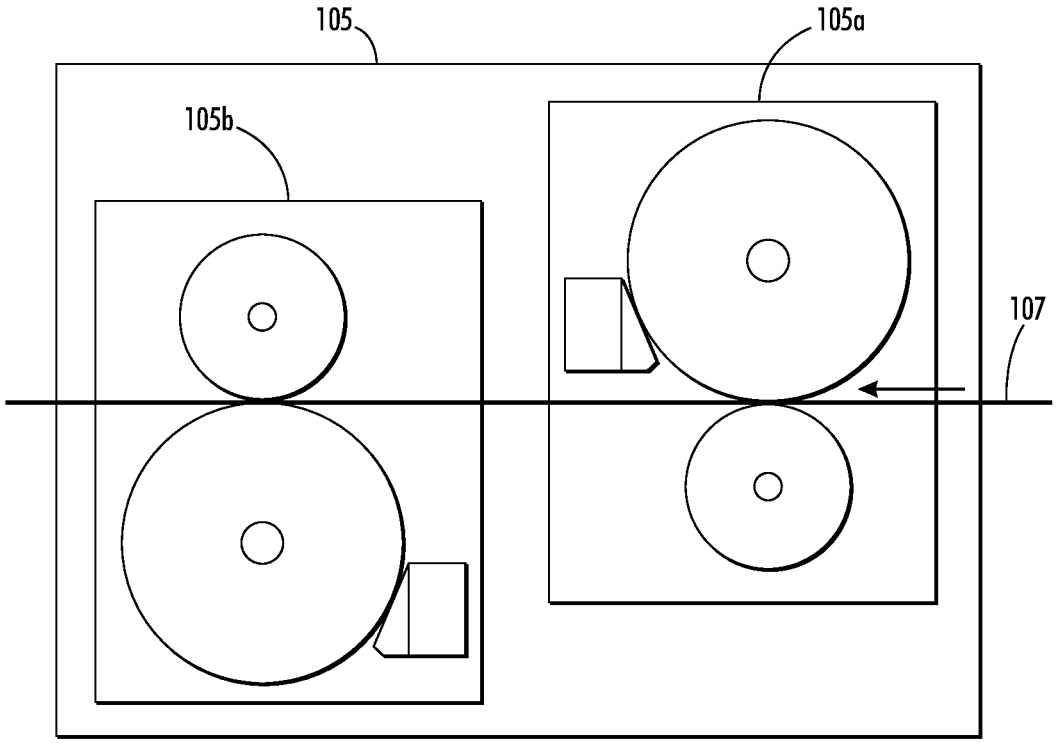
FIG. 4 is a diagram of two release agent application apparatuses set up for dual-side release agent application, according to one embodiment.

FIG. 4 is a diagram of an example configuration of release agent application apparatuses 105*a* and 105*b* to accommodate application of release agent to one or both surfaces 107*a* and 107*b* of substrate 107 based on a determined presence of one or more images and/or on demand. In this example, the release agent application apparatuses 105*a*/105*b* may not be configured to individually apply application agent to more than one side of the substrate 107. Accordingly, in order to be able to apply release agent to both a first side and a second side of the substrate, a single side release agent application apparatus 105*a* is placed in-line with another inverted single side release agent application apparatus 105*b*. This arrangement may be internal to an overall application apparatus 105 that comprises both the release agent application apparatus 105*a* and inverted release agent application apparatus 105*b*, or by two separate release agent application apparatuses 105 that are predisposed to apply release agent to a specific side of the substrate 107, or retrofitted to accomplish this task.

Figure 5:
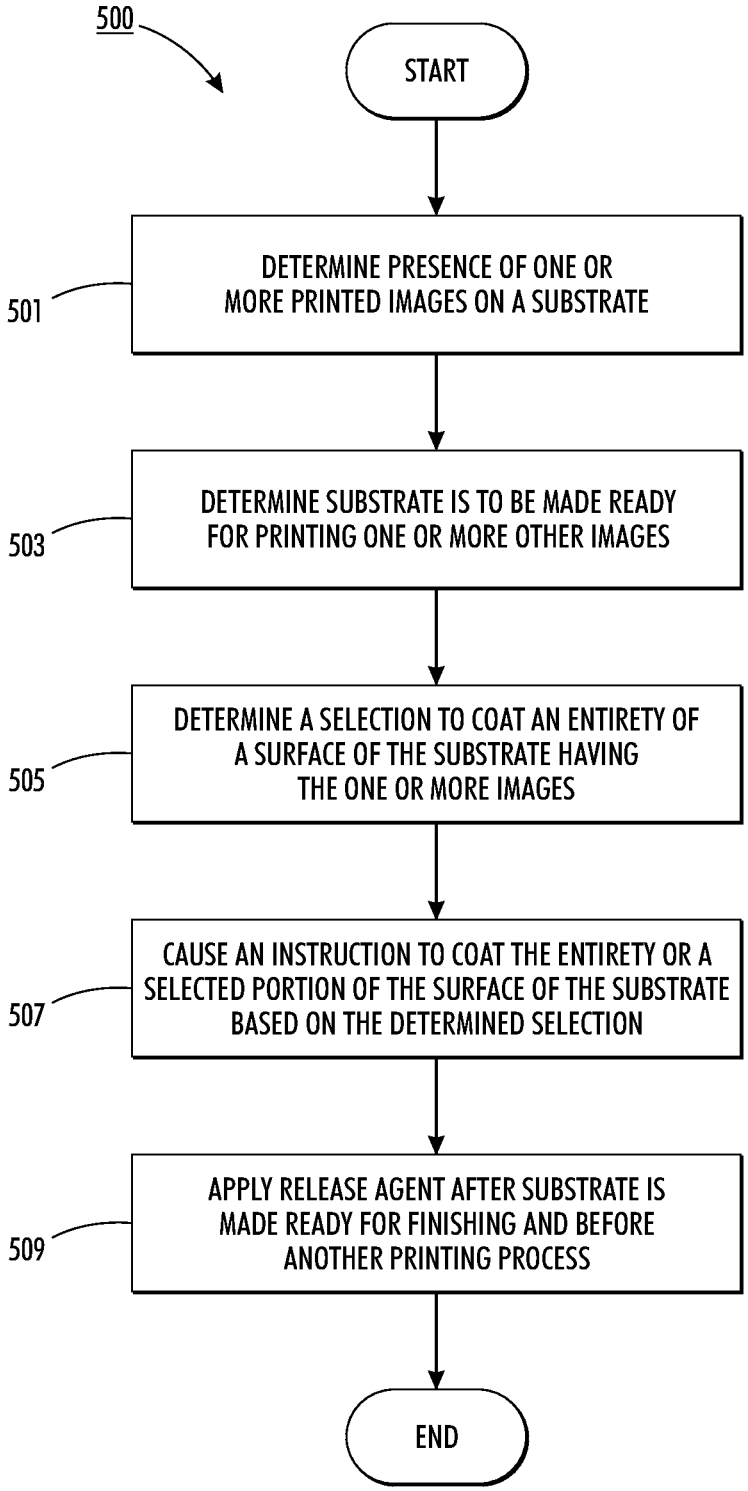
FIG. 5 is a flowchart of a process for applying a release agent to a substrate to prevent ink offset from the substrate to one or more portions of print processing equipment during a duplex printing operation, according to one embodiment.
Figure 6:
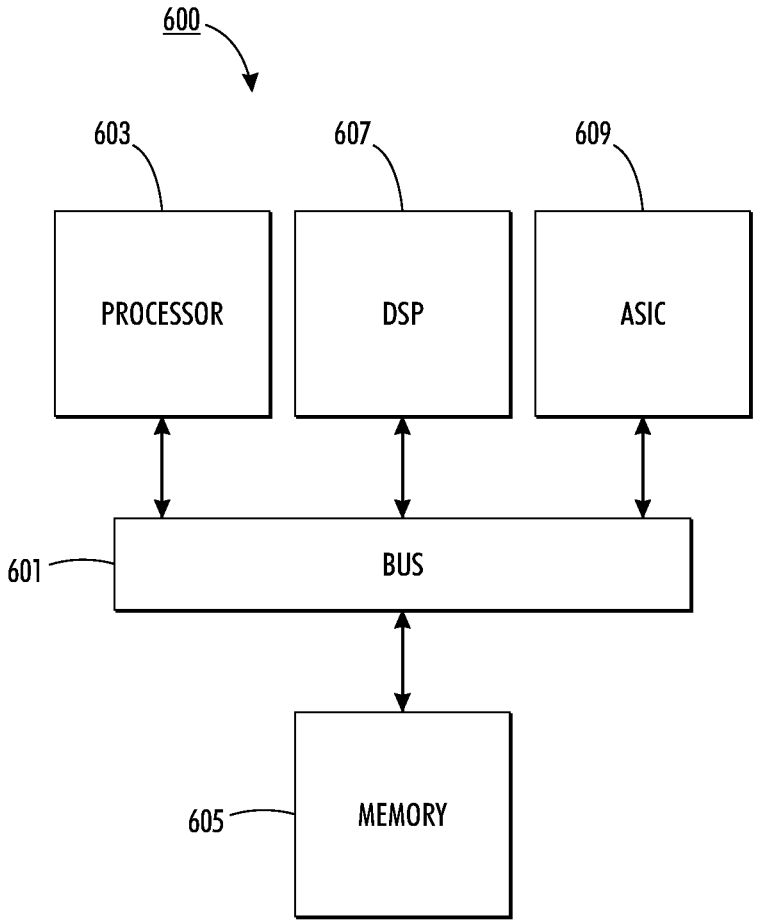
FIG. 6 is a diagram of a chip set that can be used to implement an embodiment.

FIG. 5 is a flowchart of a process for applying a release agent to a substrate to prevent ink offset from the substrate to one or more portions of print processing equipment during a duplex printing operation, according to one embodiment. In one embodiment, the release agent application apparatus 105 is caused to perform the process 500 by way of computer readable code implemented in, for instance, a chip set including a processor and a memory as shown in FIG. 6.

In step 501, release agent application apparatus 105 discussed above determines whether there is at least one ink image applied to at least one portion of one of the first surface 107*a* and the second surface 107*b* of the substrate 107 discussed above by way of one or more steps of a printing process. The printing process may be, for example, a first printing process 113 such as that discussed above. Then, in step 503, the release agent application apparatus determines the substrate 107 is to be made ready for printing one or more other images on the other of the first surface 107*a* and the second surface 107*b* by one or more steps of another printing process such as the second printing process discussed above.

Next, in step 505, the release agent application apparatus 105 determines whether a selection to cause the release agent to be applied to the entirety of at least one of the first surface 107*a* and the second surface 107*b* of the substrate 107 has been received by the release agent application apparatus 105. Then, in step 507, the release agent application apparatus 105 causes, at least in part, the release agent to be applied to cover an entirety of the one of the first surface 107*a* and the second surface 107*b* of the substrate 107 upon which the at least one ink image is applied if the selection to cover the entire surface was made. Alternatively, if no selection to cover an entirety of the surface is made, or not set as a default, the release agent application apparatus causes only selected portions of the surface 107*a*/107*b* having the determined ink image to be coated with release agent.

The process continues to step 509 in which the release agent application apparatus 105 causes, at least in part, the release agent to be applied to the substrate 107 so as to cover the at least one portion of the first surface 107*a* and the second surface 107*b* of the substrate 107 upon which the at least one ink image is applied at a time before the substrate 107 is subjected to the one or more steps of the another printing process.

As discussed above, the release agent application apparatus 105 may be any type such as, but not limited to, a nipped roller pair type, a spray nozzle type, a belt applicator type, or any combination thereof. Additionally, when the release agent application apparatus 105 is caused to apply the release agent to the substrate 107, it may do so a rate of 2 mg/A4 paper size to 12 mg/A4 paper size. In another embodiment, the release agent may be applied at a rate of 4 mg/A4 paper size to 10 mg/A4 paper size. In still another embodiment, the release agent may be applied at a rate of 7 mg/A4 paper size to 8 mg/A4 paper size. The release agent application apparatus 105, as discussed above, may be configured to control an amount of release agent that is applied within the above example ranges, or it may be configured to simply apply an amount that just falls within the above example ranges, whether that particular range is selectable or not selectable, without specificity.

The processes described herein for applying a release agent to a substrate to prevent ink offset from the substrate to one or more portions of print processing equipment during a duplex printing operation may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 6 illustrates a chip set or chip 600 upon which an embodiment may be implemented. Chip set 600 is programmed to apply a release agent to a substrate to prevent ink offset from the substrate to one or more portions of print processing equipment during a duplex printing operation as described herein may include, for example, bus 601, processor 603, memory 605, DSP 607 and ASIC 609 components.

The processor 603 and memory 605 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 600 can be implemented in a single chip. It is further contemplated that in certain embodiments the chip set or chip 600 can be implemented as a single "system on a chip." It is further contemplated that in certain embodiments a separate ASIC would not be used, for example, and that all relevant functions as disclosed herein would be performed by a processor or processors. Chip set or chip 600, or a portion thereof, constitutes a means for performing one or more steps of applying a release agent to a substrate to prevent ink offset from the substrate to one or more portions of print processing equipment during a duplex printing operation.

In one or more embodiments, the chip set or chip 600 includes a communication mechanism such as bus 601 for passing information among the components of the chip set 600. Processor 603 has connectivity to the bus 601 to execute instructions and process information stored in, for example, a memory 605. The processor 603 may include one or more processing cores with each core configured to perform independently. A multi-core processor enables multiprocessing within a single physical package. Examples of a multi-core processor include two, four, eight, or greater numbers of processing cores. Alternatively or in addition, the processor 603 may include one or more microprocessors configured in tandem via the bus 601 to enable independent execution of instructions, pipelining, and multithreading. The processor 603 may also be accompanied with one or more specialized components to perform certain processing functions and tasks such as one or more digital signal processors (DSP) 607, or one or more application-specific integrated circuits (ASIC) 609. A DSP 607 typically is configured to process real-world signals (e.g., sound) in real time independently of the processor 603. Similarly, an ASIC 609 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 603 performs a set of operations on information as specified by computer program code related to applying a release agent to a substrate to prevent ink offset from the substrate to one or more portions of print processing equipment during a duplex printing operation. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 601 and placing information on the bus 601. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 603, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 603 and accompanying components have connectivity to the memory 605 via the bus 601. The memory 605 may include one or more of dynamic memory (e.g., RAM, magnetic disk, writable optical disk, etc.) and static memory (e.g., ROM, CD-ROM, etc.) for storing executable instructions that when executed perform the inventive steps described herein to apply a release agent to a substrate to prevent ink offset from the substrate to one or more portions of print processing equipment during a duplex printing operation. The memory 605 also stores the data associated with or generated by the execution of the inventive steps.

In one or more embodiments, the memory 605, such as a random access memory (RAM) or any other dynamic storage device, stores information including processor instructions for applying a release agent to a substrate to prevent ink offset from the substrate to one or more portions of print processing equipment during a duplex printing operation. Dynamic memory allows information stored therein to be changed by system 100. RAM allows a unit of information stored at a location called a memory address to be stored and retrieved independently of information at neighboring addresses. The memory 605 is also used by the processor 603 to store temporary values during execution of processor instructions. The memory 605 may also be a read only memory (ROM) or any other static storage device coupled to the bus 601 for storing static information, including instructions, that is not changed by the system 100. Some memory, is composed of volatile storage that loses the information stored thereon when power is lost. The memory 605 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 603, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus for applying a release agent to a substrate having at least a first surface and a second surface, the apparatus comprising:

at least one metering unit configured to meter the release agent to the substrate;

wherein the metered release agent is applied to the substrate by at least one of one or more nipped roller pairs, one or more spray nozzles, one or more belts, or a combination thereof;

at least one source reservoir of release agent, wherein a source reservoir provides the release agent to the at least one metering unit by way of a connector channel;

at least one heating element configured to apply heat to the release agent at a metering unit or to aid in enhancing flow rate of or spreading of the release agent;

the one or more belts configured to apply the release agent;

at least one processor; and at least one memory coupled to the processor, wherein the at least one memory contains instructions operative on the at least one processor for applying the release agent to the substrate to prevent ink offset from the substrate to one or more portions of a print processing equipment during a duplex printing operation by:

determining a presence of at least one ink image applied to at least one portion of one of the first surface and the second surface of the substrate by way of one or more steps of a printing process;

determining if the substrate is to be made ready for printing on the other of the first surface and the second surface by one or more steps of another printing process;

causing the release agent to be applied to cover only selected portions of the one of the first surface and the second surface of the substrate upon which the at least one ink image is applied; and when it is determined that the at least one ink image was applied and that the substrate is to be made ready for printing on the other of the first surface and the second surface, causing the release agent to be applied to the substrate before the substrate is to be subjected to the one or more steps of the another printing process;

wherein the apparatus applies a controlled amount of release agent to the at least one portion of one of the first surface and the second surface of the substrate upon which the at least one ink image was applied before the substrate enters the another printing process;

two or more rollers that form the one or more nipped roller pairs, wherein the release agent is applied by at least one roller of the one or more nipped roller pairs, and the one or more nipped roller pairs causes a pressure to be exerted on the substrate to spread the release agent; wherein one roller of a nipped roller pair is less deformable than the other roller of the nipped roller pair under pressure.

2. The apparatus of claim 1, wherein causing the release agent to be applied to the substrate is causing the release agent to be applied to cover an entirety of the one of the first surface and the second surface of the substrate upon which the at least one ink image is applied.

3. The apparatus of claim 1, wherein the at least one memory contains other instructions operative on the at least one processor for:

applying the release agent at a rate of 2 mg/A4 paper size to 12 mg/A4 paper size.

4. The apparatus of claim 1, further comprising:

the one or more spray nozzles configured to apply the release agent, wherein the one or more spray nozzles are actuated to selectively apply the release agent to the substrate.

5. The apparatus of claim 4, wherein causing the release agent to be applied to the substrate is causing the release agent to be applied to cover an entirety of the one of the first surface and the second surface of the substrate upon which the at least one ink image is applied.

6. The apparatus of claim 5, wherein the pressure is in a range of 0.1 psi to 1500 psi.

7. The apparatus of claim 1, further comprising:

the one or more spray nozzles configured to apply the release agent.

8. The apparatus of claim 1, wherein the one or more spray nozzles are actuated to selectively apply the release agent to the substrate;

wherein the at least one memory, the at least one processor, and the instructions operative on the at least one processor are implemented in a chip set.

* * * * *